United States Patent [19]

Köpfli

[11] 4,010,458

[45] Mar. 1, 1977

[54] LIGHT GATE SYSTEM

[75] Inventor: Markus Köpfli, Wil, Switzerland

[73] Assignee: Cerberus AG, Mannedorf, Switzerland

[22] Filed: July 10, 1975

[21] Appl. No.: 594,880

[30] Foreign Application Priority Data

July 15, 1974 Switzerland ..... 9742/74

[52] U.S. Cl. ..... 340/258 R; 250/221; 340/258 D; 340/276

[51] Int. Cl.[2] ..... G08B 13/18

[58] Field of Search ..... 340/258 R, 258 D, 258 B, 340/276, 228 S; 250/221

[56] References Cited

UNITED STATES PATENTS

| | | | |
|---|---|---|---|
| 3,534,351 | 10/1970 | Harnden et al. | 340/258 B |
| 3,723,737 | 3/1973 | Zeldman et al. | 250/221 |
| 3,859,647 | 1/1975 | Ross | 340/258 B |
| 3,887,815 | 6/1975 | Kawakami | 340/228 S |
| 3,889,118 | 6/1975 | Walker | 250/221 |
| 3,946,241 | 3/1976 | Malinowski | 250/221 |

*Primary Examiner*—Glen R. Swann, III
*Attorney, Agent, or Firm*—Flynn & Frishauf

[57] ABSTRACT

When applying light gates in burglar alarm systems and the like, in which pulsed sources provide pulsed beams of light (which may be UV, visible, or IR radiation), an evaluation circuit is provided coupled to the pulse source which detects coincidence of radiation received when it is being transmitted and also radiation received when none is transmitted, providing an output signal if: (a) no radiation is received when radiation is transmitted, or (b) radiation is received when none is being transmitted, so that phasing of transmitted radiation, as received, with respect to the transmitter becomes an additional recognition factor.

9 Claims, 3 Drawing Figures

LIGHT GATE SYSTEM

The present invention relates to a light gate system, and more particularly to a light gate system which can be used in electronic intrusion alarms, burglar alarm systems, and the like.

Light gate systems of the type to which the present invention relates use a radiation transmitter to radiate light which may be in the ultraviolet (UV), visible, or infrared (IR) range. The receiver utilizes an evaluation circuit which evaluates the received signals. Such light gates, as used for example in burglar alarm systems, intrusion alarms and other arrangements of this type, provide radiation which, directly, or after collimation, deflection, or reflection and the like, eventually reaches a receiver. If the path of radiation is interrupted, for example by an intruder, an evaluation circuit provides an alarm.

Sophisticated burglars have always tried to outguess such intrusion alarm systems and to render them inoperative. Ordinary light gates can be outwitted by providing additional radiation to the receiver by means of an auxiliary radiation source supplied by the intruder himself, thus permitting passing the light gate without providing an alarm output. To continue rendering the gate operative, it has been proposed to modulate the radiation and to utilize a receiver which is tuned to the modulation frequencies. Such light gates also can be outwitted, however, by measuring the modulation frequency of the radiation emitted by the transmitter — which is simple — and provide an auxiliary radiation source of variable modulation frequency in order to irradiate the receiver with the proper modulation frequency.

It is an object of the present invention to further improve such intrusion alarm systems by providing additional reliability and security by further adding to the recognition factors required to be outwitted without, however, substantially increasing the complexity of the system, so that proper intrusion alarm responses will be obtained.

SUBJECT MATTER OF THE PRESENT INVENTION

Briefly, radiation is transmitted not only through the protected light gate from a transmitter to a receiver, but additionally signals are transmitted to the receiver to synchronize an evaluation circuit therefor; the evaluation circuit is so arranged that it responds to provide an alarm if (a) radiation pulses are not received by the receiver during transmission of radiation, or (b) radiation is received in the gaps or pulses between emitted radiation pulses from the transmitter.

Recognition of properly received radiation thus utilizes not only the pulse frequency of the radiation, but additionally the phase position of the pulses received by the receiver with respect to the pulses transmitted by the transmitter. It is very difficult to outwit such a light gate with an additional light source which sends pulses of the same frequency since it is extremely unlikely, and hardly possible, to synchronize an auxiliary wide frequency band light source to have the same phase position as the radiation source, and to maintain the same phase position.

The invention will be described by way of example with reference to the accompanying drawings, wherein.

Figure 1:
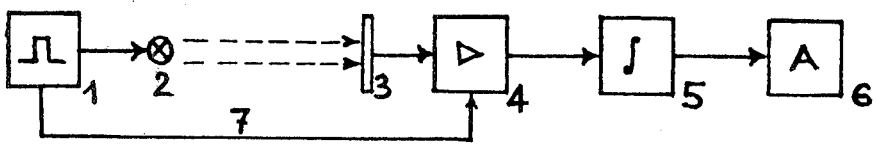
FIG. 1 is a highly schematic block diagram of the system in accordance with the present invention.

A pulse source 1 (FIG. 1) controls a radiation source 2 to provide radiation in pulse form. The radiation source may be a lamp, a light-emitting semiconductor, a laser, or another suitable source of visible, IR, or UV radiation. Visible, or IR radiation is preferred. The radiation is directed to a receiver 3 which is responsive to the selected wave length, such as a photo resistor, a photo transistor, a photo diode, or the like. The radiation may be directly applied thereto or, if desired, may be collimated and directed by single or multiple reflection to the receiver 3. The output signal of receiver 3 is applied to an amplifier 4. Amplifier 4 is additionally controlled by a separate line 7 from pulse source 1. The amplifier 4 includes the evaluation circuit which has a logic built in, so arranged to detect if during predetermined time periods, controlled by the pulse source over line 7, radiation pulses are received at the receiver 3. Preferably, the time periods selected are somewhat longer than the pulse duration of the pulses emitted from transmitter 2 itself. An alarm signal is applied to an alarm device 6 if signals are not received by the receiver 3 during the gating-open time thereof. Preferably, a storage or integration circuit 5 is interposed between the amplifier 4 and the alarm circuit 6 to store the signal derived from the circuit 4 for a short period of time and to only cause an alarm to be emitted if the output signal from circuit 4 persists for a predetermined time period, for example for the time period required to span two to three, or any few number of predetermined pulses.

Figure 2:
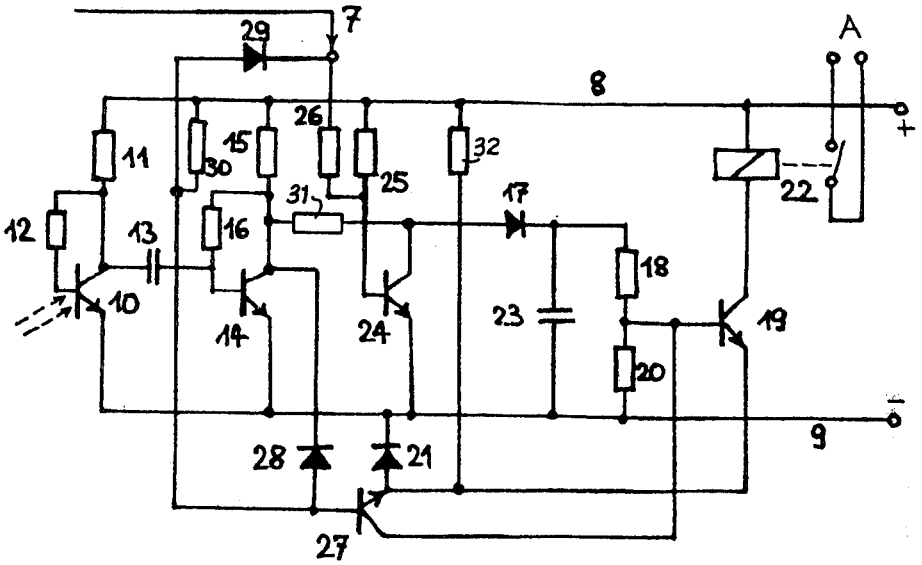
FIG. 2 is a schematic, more detailed circuit diagram of the system of FIG. 1.

FIG. 2 illustrates the entire system. Main buses 8, 9 have a photo transistor 10 connected thereacross through a collector resistor 11. A base resistor 12 connects the collector to the base. The output signal of the photo transistor, which is located to be subjected to radiation from source 2, is applied over a capacitor 13 to an amplifier stage which includes a transistor 14, and its collector resistor 15 and base resistor 16. The output signal of transistor 14 is applied via resistor 31 through a diode 17 to the base of a transistor 19 through a voltage divider formed of resistors 18, 20. The emitter of transistor 19 is connected to bus 9 through a diode 21. The collector of transistor 19 is connected through the winding of an alarm relay 22 to positive bus 8. A storage capacitor 23 is connected in parallel to the resistors 18, 20.

Operation: Radiation pulses impinging on photo transistor 10 are transformed into electrical pulses to charge capacitor 23 over transistor 14. Transistor 19 is conductive when capacitor 23 is charged, thus relay 23 is energized and the normally closed circuit of alarm circuit A is open. If pulses are not applied to the photo transistor, capacitor 23 will discharge over resistors 18, 20, thus causing blocking of transistor 19 and de-energization of the coil of relay 22. The relay will drop out, thus closing the normally closed contacts of the alarm circuit and causing an alarm signal.

In accordance with a feature of the invention, the collector-emitter path of transistor 14 is bridged by a second transistor 24. The base of transistor 24 is connected through base resistor 25 to positive bus 8. Additionally, the base of transistor 24 is connected through resistor 26 to line 7 which, in turn, is connected to the pulse source 1. If there is no control voltage from pulse source 1 applied through line 7, that is, during the gaps between pulses, transistor 24 is conductive, so that the output stage of transistor 24, and hence transistor 14 is short-circuited, not permitting pulses to pass. The pulses which are applied to transistor 24 should be somewhat longer than the actual radiation pulses emitted from source 2. These pulses cause transistor 24 to block so that pulses transmitted from photo transistor 10 over amplifying transistor 14 to transistor 19 can be normally evaluated.

A further transistor 27 is connected with its collector to the base of transistor 19 and with its emitter to the emitter of transistor 19 and to diode 21. The base of transistor 27 has a diode 28 connected to the collector of transistor 14, a diode 29 connected to line 7, and a resistor 30 connected to bus 8, operating as a base resistance. Resistor 32 is connected between the emitter of transistor 27 and bus 8. Transistor 27 is held in blocked condition during the control pulses and opens in the intervals between control pulses. If, during the control pulse intervals, a light pulse is provided, transistor 27 will directly apply a signal to the base of transistor 19, thus causing relay 22 to drop off, and initiating an alarm.

The circuit is described thus provides an alarm signal if, during the synchronization pulse from impulse generator 1, there are no light pulses but also if, in the interval between synchronization pulses, radiation should be present. Additionally, the alarm relay is connected in a fail-safe circuit, that is, provides an output if there is interruption or interference in the electrical circuitry, or the line voltage in buses 8, 9 is disconnected or disabled. Thus, the circuit is essentially self-monitoring.

Figure 3:
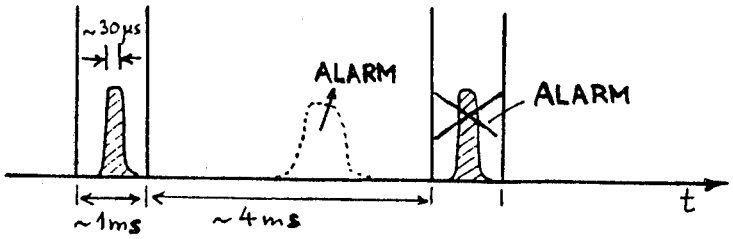
FIG. 3 is a graph illustrating operation of the system.

As illustrated in FIG. 3, synchronization pulses can be provided by the pulse source having a duration of approximately one millisecond, with an interval between pulses of about four milliseconds. Radiation flashes, controlled by the control impulses, are initiated with a slight time delay after the leading flank of the control pulses has been received. The flashes may have a duration of about 30 microseconds, so that they are entirely within the synchronization pulse width. The storage capacitor 23 has a capacity which is so selected that an alarm signal is provided if two to three pulses are missing. FIG. 3 graphically illustrates the alarm, if radiation is received in the pulse interval by the pulse shown in dotted lines; additionally, an alarm is generated if a flash is missing during a pulse interval as determined by the pulse source 1, as graphically illustrated in the second representation of the flash which is crossed off. Receipt of a light pulse, for example as shown in the broken-line form in the four millisecond interval, will immediately trigger drop-out of relay 22 since transistor 27 directly controls the base of transistor 19 without requiring charge storage on capacitor 23. A single flash of radiation which is out-of-phase with respect to the radiation interval as determined by the pulse source 1 will, therefore, trigger the alarm.

Various changes and modifications may be made within the scope of the inventive concept. For example, changing the frequency of the pulse source 1, even within comparatively narrow limits, by changing the duration of the pulse gaps between pulse intervals will additionally improve the reliability of detection and the resistance of the system to being outwitted by external spurious radiation sources, since such a spurious source will comparatively soon provide a pulse which will fall within the pulse gaps. This effect can also be obtained by normal drift of components. The receiver is self-synchronized with respect to the transmitter by line 7 and responds with an alarm signal upon absence of receipt of a radiation flash when such a flash should be received, or upon presence of radiation when no flash is being transmitted, regardless of the relative timing of a flash with respect to the next preceding one.

I claim:

1. Light gate system having a radiation transmitter (2), a radiation receiver (3, 10), an output stage (19), and an evaluation circuit (4, 5) comprising a pulse source (1) connected to and controlling the radiation transmitter (2) to emit a radiation pulse in the time interval during persistence of a control pulse from the source (2); and wherein the evaluation circuit (4, 5) comprises circuit means (13, 14, 17, 18, 20) connecting the radiation receiver (3, 10) to said output stage (19), controlling said output stage to assume a first state upon presence of radiation pulses detected by the radiation receiver (3, 10) and an alarm state upon absence of detection of radiation pulses, said circuit means including a controllable switch (24) connected across the input of the output stage (19) and controlled by the pulse source (1) to block transmission of pulses from the radiation receiver (3, 10) to the output stage (19) during the gaps between control pulses from the pulse source (1); and a phasing supervision stage (27) connected to the output stage (19) and connected to and controlled by the pulse source (1), the phasing supervision stage being open during pulse gaps between control pulses from the pulse source (1) and permitting application of radiation pulses received from the radiation receiver (10) during said gaps to the output stage (19) to control the output stage to assume the alarm state so that the output stage (19) will logically provide an alarm output signal a. upon failure of the radiation receiver (3, 10) to detect a radiation pulse when the control pulse coupled from the pulse source (1) is present, or b. upon detection by the radiation receiver (3, 10) of radiation when the control pulse coupled from the pulse source (1) is absent.

2. System according to claim 1, wherein the output stage comprises a transistor (19) and a normally closed relay (22), the transistor (19) being conductive when in the first state and, when in the alarm state, being blocked, causing the normally closed relay to close and operate an alarm circuit (A, 6).

3. System according to claim 1, wherein the controllable switch comprises a transistor (24), a connecting line (7) connecting the control electrode of the transistor (24) to the pulse source (1), the transistor being connected to short-circuit the output stage (19) upon absence of a control pulse on the connecting line (7).

4. System according to claim 1, further comprising a storage capacitor (5, 23) connected to the input of the output stage (19) to store for a limited period of time signals representative of pulses transmitted from the radiation receiver (3, 10) to prevent change of the output stage to alarm state upon absence of one, or a limited predetermined number of pulses transmitted from the radiation receiver to the output stage.

5. System according to claim 1, further comprising a storage capacitor (23) connected in circuit between the radiation receiver (10) and the output stage (19) to store a limited number of signals representative of radiation received by the receiver and to inhibit change of state of the output stage to alarm state upon absence of one, or a limited number of pulses received from the radiation receiver, the phasing supervision stage (27) being connected directly to the output stage (19) to provide immediate response of the output stage upon detection of radiation during a gap between control pulses emitted from the pulse source (1).

6. System according to claim 4, further comprising a decoupling diode (17) connected in circuit with the capacitor (23) to prevent discharge of the capacitor through the controllable switch (24) when the controllable switch is closed.

7. System according to claim 5, further comprising a decoupling diode (17) connected in circuit with the capacitor (23) to prevent discharge of the capacitor through the controllable switch (24) when the controllable switch is closed.

8. System according to claim 1, further comprising decoupling means (28, 29) decoupling said circuit means (13, 14, 17, 18, 20) connecting the radiation receiver (3, 10) to the output stage and said phasing supervision stage (27) from each other.

9. System according to claim 7, further comprising decoupling means (28, 29) decoupling said circuit means (13, 14, 17, 18, 20) connecting the radiation receiver (3, 10) to the output stage and said phasing supervision stage (27) from each other.

* * * * *